US007536135B2

(12) United States Patent
Imai

(10) Patent No.: US 7,536,135 B2
(45) Date of Patent: May 19, 2009

(54) ROTOR DRIVE CONTROLLING UNIT AND AN IMAGE FORMATION APPARATUS

(75) Inventor: Satoshi Imai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 325 days.

(21) Appl. No.: 11/594,159

(22) Filed: Nov. 8, 2006

(65) Prior Publication Data

US 2007/0122194 A1 May 31, 2007

(30) Foreign Application Priority Data

Nov. 29, 2005 (JP) ..... 2005-344268

(51) Int. Cl.
*G03G 15/00* (2006.01)

(52) U.S. Cl. ..... 399/167

(58) Field of Classification Search ..... 399/167, 399/159; 318/683

See application file for complete search history.

(56) References Cited

U.S. PATENT DOCUMENTS

| | | | |
|---|---|---|---|
| 6,278,857 | B1 * | 8/2001 | Monji et al. |
| 6,713,983 | B2 * | 3/2004 | Maruyama |
| 2008/0231223 | A1 * | 9/2008 | Imai et al. |

FOREIGN PATENT DOCUMENTS

| | | |
|---|---|---|
| JP | 63-113477 | 5/1988 |
| JP | 06-227062 | 8/1994 |
| JP | 06-234253 | 8/1994 |
| JP | 06-327278 | 11/1994 |
| JP | 2000-137424 | 5/2000 |
| JP | 2000-295882 | 10/2000 |
| JP | 2000-356929 | 12/2000 |
| JP | 2002-072816 | 3/2002 |
| JP | 2005-227858 | 8/2005 |
| JP | 2005-312262 | 11/2005 |

* cited by examiner

*Primary Examiner*—Susan S Lee
(74) *Attorney, Agent, or Firm*—Harness, Dickey & Pierce PLC

(57) ABSTRACT

A rotor drive controlling unit and an image formation apparatus includes a motor, a transfer device for transferring a rotational force of the motor, a rotor rotated by the rotational force of the motor, at least three elements-to-be-detected arranged on a periphery of the rotor, a detector for detecting the elements-to-be-detected, a passage time detecting unit for detecting an interval between adjacent elements-to-be-detected, an amplitude/phase generating unit for generating an amplitude and a phase of a rotation period fluctuation of a desired period of the rotor, a rotation controlling unit for controlling rotation of the motor and for reducing the rotation period fluctuation, and a control reference updating unit for updating the phase at which a rotation control of the motor is started, based on the phase generated by the amplitude/phase generating unit with reference to the elements-to-be-detected when widths of the at least three elements-to-be-detected mutually differ.

11 Claims, 15 Drawing Sheets

ROTOR DRIVE CONTROLLING UNIT AND AN IMAGE FORMATION APPARATUS

BACKGROUND OF THE INVENTION

1. Field of the Invention

The present invention relates to a rotor drive controlling unit for reducing a rotation period fluctuation of a rotor, when the rotor is rotationally driven by a motor, and the like; and an image formation apparatus including the rotor drive controlling unit.

2. Description of the Related Art

With reference to FIG. 1, an image formation apparatus, in general, is described. FIG. 1 shows a color image formation apparatus such as a 4-color tandem type color printer. The image formation apparatus includes a controller 5 for controlling the entirety of the image formation apparatus, and photo conductor drums 1*a* through 1*d*. A latent image representing an image in black color is formed on the photo conductor drum 1*a*; a latent image representing an image in cyan color is formed on the photo conductor drum 1*b*; similarly, a latent image for magenta is formed on 1*c*; and for yellow on 1*d*. The image formation apparatus further includes exposing units 2*a* through 2*d* for forming the latent images for the respective colors on the corresponding photo conductor drums 1*a* through 1*d*. The image formation apparatus further includes motors 6*a* through 6*d* for rotating the corresponding photo conductor drums 1*a* through 1*d*. A belt 3 is driven by a belt driving motor 4 for conveying an imprinting medium 7, such as paper.

Next, operations of the image formation apparatus shown by FIG. 1 are described. First, the imprinting medium 7 is conveyed to the belt 3 from a feed unit that is not illustrated, delivered to the belt 3, and sequentially conveyed to the photo conductor drums 1*a* through 1*d* for each of the colors. At this time, the latent images are formed on the corresponding photo conductor drums 1*a* through 1*d* from above by the corresponding exposing units 2*a* through 2*d*. Then, toner is transferred to exposed parts of the corresponding photo conductor drums 1*a* through 1*d*. The toner is then transferred to the imprinting medium 7 that comes just under each of the photo conductor drums 1*a* through 1*d*. In the image formation apparatus as shown in FIG. 1, the photo conductor drums 1*a* through 1*d* are driven by corresponding DC brushless motors, and the like. Due to the following reasons (i) and (ii), the formed image tends to have a positioning error in sub scanning directions, namely:

(i) motor rotation period fluctuation due to a torque ripple, and the like; and (ii) an error caused by a driving force transfer system such as an accumulated gear pitch error, and an eccentricity of a rotating axle.

The positioning error in the configuration shown by FIG. 1 occurs, for example, when planet gears are used between the motors 6*a* through 6*d* and the photo conductor drums 1*a* through 1*d*, respectively. The positioning error due to the errors occurs not only in the case of the configuration shown in FIG. 1, but also in the case of a revolving system wherein images in two or more colors are formed with one photo conductor, and in the case of a monochrome system with one photo conductor.

The image formation apparatus that is configured as shown in FIG. 1 is capable of delivering a color image at high speed, and accordingly, is widely used. With this configuration, the positioning error between images formed in different colors results in erroneous superposition of the colors, then the so-called color shift occurs, and image quality is notably degraded.

Conventionally, various countermeasures are taken in order to improve the quality of images produced by image formation apparatuses. Concerning the rotation period fluctuation of a DC servomotor, a control system is used, wherein the angular velocity of motor axle rotation is detected and fed back. Further, concerning the error due to the driving force transfer system, a rotary encoder is provided on the axle of the photo conductor drum such that rotation of the motors 6*a* through 6*d* is detected and controlled. Furthermore, in a manufacturing stage, the maximum eccentricity position of gears on the same axle as the photo conductor drum axle is detected, and the four photo conductor drums are assembled while adjusting the gearing eccentricity positions of the photo conductor drum axles. In this way, each phase of the rotation period fluctuation due to eccentricity is synchronized, and the color shift is mitigated.

As a method of mitigating the color shift by synchronizing the phases of the rotation period fluctuations, which are periodic, of two or more photo conductor drums, Patent Reference 1 and Patent Reference 2 propose that a reference position be predetermined. At the reference position, the phases of the rotation period fluctuations of the photo conductor drums become the same so that the photo conductor drums can be driven with the phases of the rotation period fluctuations agreeing with each other, and so that imprinting can be carried out at the same position. Further, as described above, the method can be carried out by detecting the maximum eccentricity positions of the gears on the axles of the photo conductor drums, and assembling the photo conductor drums with highly precise axle matching so that the phases can be aligned in order to mitigate the color shift that may occur when superposing two or more colors.

Even if the phases of the rotation period fluctuation are aligned so that the color shift due to the photo conductor drum rotation period fluctuation can be mitigated by the method, amplitudes of the rotation period fluctuations differ with the photo conductor drums. The difference in the amplitudes causes the color shift. That is, even if the phases of the rotation period fluctuations of the photo conductor drums are aligned for reducing a relative amount of the color shift, the color shift due to the difference in the amplitudes of the rotation period fluctuations remains. Accordingly, in order to obtain a high quality image with less color shift, it is necessary to reduce an absolute amount of the amplitude. Here, it is known that a positioning error of a pixel due to the amplitude of the rotation period fluctuation during one rotation of the drum is greater than a positioning error of the pixel due to the amplitude of a rotation period fluctuation of other devices.

In this connection, Patent Reference 3 proposes a method of reducing the amplitude of the rotation period fluctuation, wherein the frequency of the rotation period fluctuation is analyzed, a frequency component for compensation is detected, and control is carried out. However, according to the method of Patent Reference 3, a great number of elements-to-be-detected such as slits of an encoder for detecting the rotation period fluctuation are required; accordingly, the cost of the structure tends to be high.

In an attempt to solve the problem, methods of detecting and controlling only a rotation period fluctuation that affects the image quality are considered. For example, Patent Reference 4 proposes a method wherein a frequency component equivalent to a rotation period fluctuation of a drum axle is calculated by carrying out a frequency analysis of the rotation period fluctuation of the motor axle and by multiplying the frequency component by a gear reduction ratio; then the rotation of a motor is controlled based on a result of the calculation.

Further, Patent Reference 5 proposes a method wherein time between slits of a rotation plate is measured such that a rotation period fluctuation is detected. This method requires a smaller number of slits, or slit intervals, and provides a simpler and more economical solution than a conventional method wherein a rotary encoder detects a rotation period fluctuation by counting the number of slits of a rotation plate passing during a predetermined time.

Patent Reference 6 proposes a method wherein drive-unit control is started based on a specified speed value stored in a storage unit, control is sequentially performed, so that a moving speed fluctuation of an image supporting body is reduced. Further, Patent Reference 7 proposes a method wherein a rewritable storage unit is provided, and even when a rotation fluctuation of a photo conductor occurs due to a temperature change, wear of a reduction gear, etc., change of the speed is detected at a suitable timing and the rotation fluctuation is controlled.

Furthermore, Patent Reference 8 and Patent Reference 9 propose a method wherein an interval between timing pulses that become high level when passing slits is changed so that a reference position to start controlling is detected.

[Patent Reference 1] JP H8-10372
[Patent Reference 2] JPA 2000-137424
[Patent Reference 3] JPA 2002-72816
[Patent Reference 4] JPA 2000-356929
[Patent Reference 5] JPA 2005-312262
[Patent Reference 6] JPA 2000-295882
[Patent Reference 7] JP 3259440
[Patent Reference 8] JPA H6-227062
[Patent Reference 9] JPA H6-234253

OBJECT OF THE INVENTION

However, according to Patent Reference 4, although compensation control of the rotation period fluctuation is carried out while detecting the rotation period fluctuation of a follower moving axle based on the detected result of the rotation period fluctuation of the drive axle, the timing of compensating for the rotation period fluctuation is not taken into consideration, and a quick start of compensation control is not obtained. According to Patent Reference 5, although the reference position and the rotation period fluctuation are simultaneously detected by differentiating the slit widths, providing two or more reference positions corresponding to the rotation period fluctuation and starting control at each reference position are not taken into consideration. For this reason, a high-speed start of compensation control is not obtained.

According to Patent Reference 6 and Patent Reference 7, a sensor for detecting the reference position is required in addition to a sensor for detecting the rotation period fluctuation for compensating for the timing of the rotation period fluctuation. For this reason, the number of sensors is increased, leading to an increased cost, enlargement of the detection apparatus, and complication of an input-output process. Especially, when the rotation period fluctuation has to be compensated for at a high speed, two or more slits for reference detection are required, and they cannot be practically used for detecting the rotation period fluctuation.

According to Patent Reference 8 and Patent Reference 9, reference detection for starting the control is carried out by differentiating the slit width for reference position detection from other slits. However, this is for detecting a reference of a character member such as a daisy wheel, and is not for detecting a reference for compensating for the rotation period fluctuation. In other words, this is not for beforehand detecting the rotation period fluctuation of a rotor such as by an encoder, and compensating for the rotation period fluctuation.

SUMMARY OF THE INVENTION

The present invention provides a rotor drive controlling unit and an image formation apparatus that substantially obviate one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention will be realized and attained by a rotor drive controlling unit and an image formation apparatus particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides a rotor drive controlling unit and an image formation apparatus as follows.

The rotor drive controlling unit according to the embodiment includes slits that serve as elements-to-be-detected for detecting both rotation period fluctuation and reference, and two or more of the slits are used for reference detection. In this way, the reference detection for rotation control and starting the rotation control can be quickly carried out. Further, the embodiment includes an image formation apparatus that employs the rotor drive controlling unit.

MEANS FOR SOLVING A SUBJECT

According the embodiment, the rotor drive controlling unit includes:

a motor;

a transfer device for transferring rotational force of the motor;

a rotor connected to the transfer device and rotated by the rotational force of the motor;

at least three elements-to-be-detected each having a different width from others arranged on a periphery centered on a rotation axle of the rotor;

a detector for detecting the elements-to-be-detected;

a passage time detecting unit for detecting an interval between adjacent elements-to-be-detected passing the detector based on detecting signals generated by the detector;

an amplitude/phase generating unit for generating an amplitude and a phase of a rotation period fluctuation of a desired period of the rotor based on the interval detected by the passage time detecting unit;

a rotation controlling unit for controlling rotation of the motor based on the amplitude and the phase generated by the amplitude/phase generating unit and for reducing the rotation period fluctuation; and a control reference updating unit for updating a phase, at which phase a rotation control of the motor is started, based on the phase generated by the amplitude/phase generating unit with reference to the elements-to-be-detected where a width of each element-to-be-detected is different from others.

According to the configuration described above, the rotation period fluctuation is detected based on intervals between elements-to-be-detected, and the reference is detected based on the widths of the elements-to-be-detected. In this way, no sensor for exclusively detecting the reference is required; and the rotation control of reducing the rotation period fluctuation can be quickly started.

According to another embodiment, intervals between elements-to-be-detected of pairs among at least three pairs are differentiated.

With this configuration, the intervals between the pairs of the elements-to-be-detected are differentiated such that the pairs can be identified by the passage of time; detection of the rotation period fluctuation and detection of the rotation control reference are separately carried out. In this way, the rotation control for reducing the rotation period fluctuation can be quickly started without requiring a sensor for exclusively detecting the reference.

According to another embodiment, either widths of at least three elements-to-be-detected are differentiated, or intervals between elements-to-be-detected of pairs where there are at least three pairs are differentiated; and further, rotation period fluctuations of at least two rotational bodies (such as a motor and a drum) are repetitively compensated for by the passage time detecting unit, the amplitude/phase detecting unit, the rotation controlling unit, and the control reference updating unit.

With this configuration, the rotation control of each of the rotation period fluctuations and each of the references are detected by one of the differentiated widths and the differentiated intervals without a sensor exclusively for detecting the references, and the rotation control for reducing the rotation period fluctuations can be quickly started.

According to another embodiment, the control reference updating unit updates a phase at which the rotation control is collectively to start about the two or more rotation period fluctuations to be compensated for based on each of the phases generated by the amplitude/phase generating unit. By configuring in this way, even when the rotation period fluctuations of two or more rotors are to be compensated for, the rotation control for reducing the rotation period fluctuations at any desired reference points can be started by collectively updating the phase information for every reference point.

According to another embodiment, the passage time detected by the passage time detecting unit is a semicircle term of the rotation period fluctuations to be compensated for and the phase difference between each interval is shifted by ¼ of the rotation period fluctuation period. In this way, the configuration, wherein the elements-to-be-detected are arranged at every ¼ period for improving detection sensitivity, is capable of detecting the rotation period fluctuation, and compensating for the rotation period fluctuation with a high sensitivity without using an exclusive sensor for detecting the reference.

According to another embodiment, the control reference updating unit, using the amplitude/phase generating unit, sequentially generates an amplitude and a phase of the rotation period fluctuation concerning the desired period of the rotor, and updates phase information corresponding to two or more elements-to-be-detected that serve as the reference points. With this configuration, the rotation period fluctuation is detected while in operation without using a sensor for exclusively detecting the reference. Accordingly, even if the amplitude and the phase of the rotation period fluctuation are changed with passage of time and environments, compensation can be carried out.

According to another embodiment, the elements-to-be-detected are arranged on a rotation plate that rotates centered on a rotation axle of the rotor. By configuring in this way, the rotation period fluctuation can be detected without using a sensor for exclusively detecting the reference, and highly precise rotation control is obtained.

According to another embodiment, two detectors are provided symmetric to the rotation axle of the rotor. In this way, highly precise rotation control is available; an influence due to eccentricity of the elements-to-be-detected can be eliminated without using a sensor for exclusively detecting the reference; and precise rotation control is obtained.

According to another embodiment, the elements-to-be-detected are arranged so that the widths get greater one by one within a limit of one rotation of the rotor. In this way, detection of the rotation period fluctuation is facilitated.

According to another embodiment, the elements-to-be-detected are arranged so that the intervals get greater one by one within a limit of one rotation of the rotor. In this way, detection of the rotation period fluctuation is facilitated.

Another embodiment provides an image formation apparatus that includes the rotor drive controlling unit as described above, wherein the rotor is a photo conductor drum.

The image formation apparatus configured as above can be manufactured at low cost, wherein the rotation control can be quickly started because the rotation control of the photo conductor drum is carried out without using a sensor for exclusively detecting the reference.

BRIEF DESCRIPTION OF THE DRAWINGS

FIG. 4 gives graphs showing relationships between compensation reference slits and the rotation period fluctuation ("Drum Velocity") that is measured, and a motor velocity (target) to be compensated for;

DESCRIPTION OF THE PREFERRED EMBODIMENTS

In the following, embodiments of the present invention are described with reference to the accompanying drawings.

Embodiment 1

Figure 1:
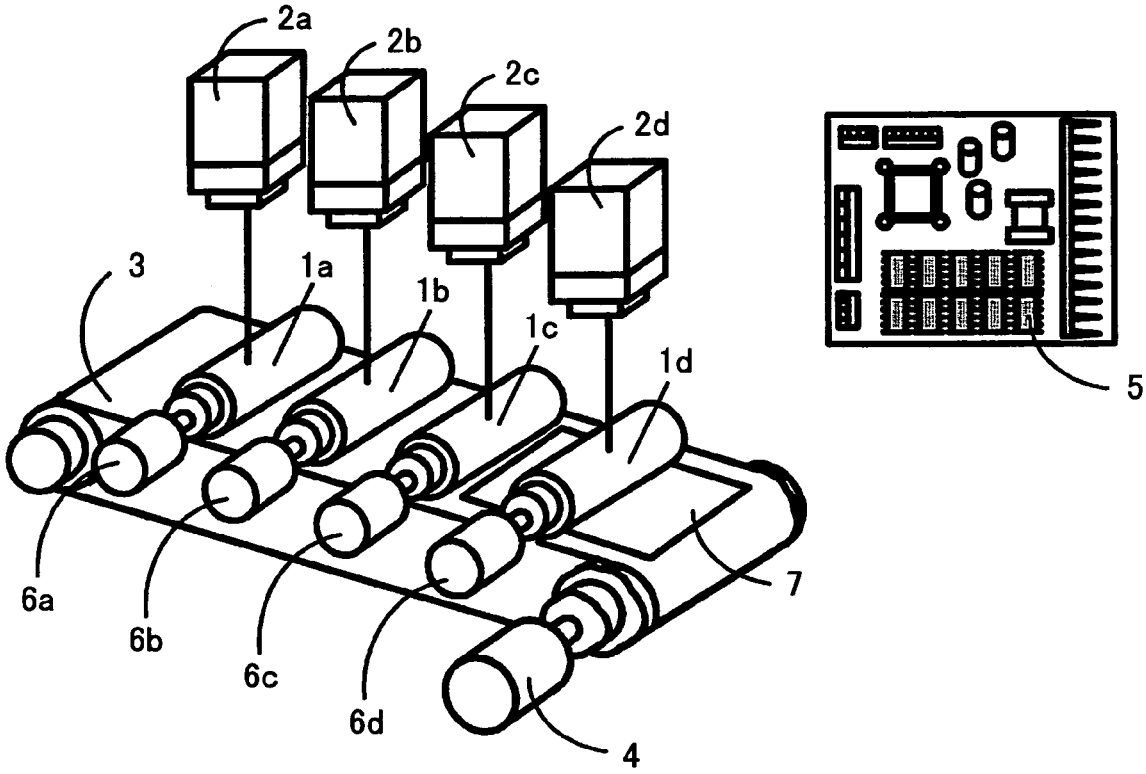
FIG. 1 is a perspective diagram of an example of an image formation apparatus.
Figure 2:
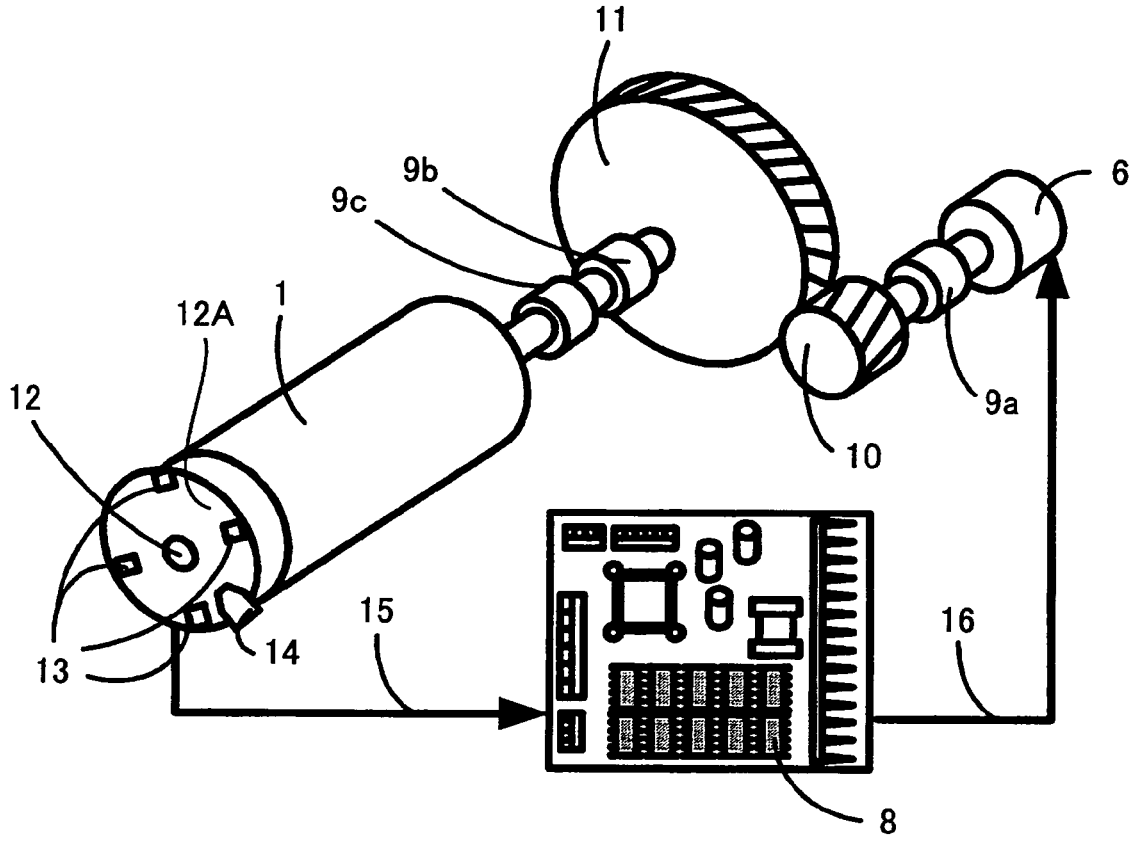
FIG. 2 is a perspective diagram of a drive controlling unit of a photo conductor drum, which drive controlling unit is an example of a rotor drive controlling unit.

Embodiments of the present invention are described taking an example of an image formation apparatus that includes a drive controlling unit as shown in FIG. 2. The drive controlling unit shown in FIG. 2 represents one of the drive controlling units of the photo conductor drum drive controlling mechanism shown in FIG. 1.

The drive controlling unit includes a DC servo motor 6 (the motor 6) for rotationally driving a drive reduction gear 10 through a coupler 9*a*. The drive reduction gear 10 transmits driving force to a follower reduction gear 11, and the follower reduction gear 11 rotates a photo conductor drum 1 through couplers 9*b* and 9*c* to a rotation axle 12 of the photo conductor drum 1, and a rotation plate 12A that includes elements-to-be-detected (slits) 13. The rotation plate 12A is rotationally driven by the rotation axle 12. When the elements-to-be-detected (slits) 13 pass a detector 14, the detector 14 generates and transmits a pulse signal 15 to a controller 8. The controller 8 detects a rotation period fluctuation of the photo conductor drum 1, and a motor velocity reference signal 16 is provided to the motor 6 so that the rotation period fluctuation may be reduced.

The photo conductor drum 1 is driven by the motor 6 through the drive reduction gear 10 and the follower reduction gear 11 fixed to the rotation axle 12 of the photo conductor drum 1. A gearing reduction ratio is, e.g., 1:20. Here, the gear train of the rotation drive mechanism is made of one step (that is, two gears) in order to reduce the number of components for reducing the cost, and in order to reduce a factor of a tooth profile error and a transfer error due to eccentricity. Further, by setting up a high reduction ratio in view of the one-step reduction gearing mechanism, the diameter of the follower reduction gear 11 becomes greater than the diameter of the photo conductor drum 1. Accordingly, a pitch error of the follower reduction gear 11 as converted into the photo conductor drum 1 becomes small. That is, the pitch error that causes a printing positioning error in the sub scanning direction is reduced, and concentration unevenness (banding) is reduced. Here, the reduction ratio is determined based on a rotation angular-velocity range that provides high efficiency in view of the target rotation angular velocity of the photo conductor drum 1 and the DC motor characteristics.

According to Embodiment 1, the coupler 9*a*, the drive reduction gear 10, the follower reduction gear 11, and the couplers 9*b* and 9*c* constitute a transfer device, and the photo conductor drum 1 constitutes a rotating body. Further, the controller 8 includes a passage time detection unit, an amplitude phase generating unit, a rotation controlling unit, and a control reference updating unit.

As for rotation period fluctuations of the photo conductor drum rotation axle 12, three major ones are conceivable. One is a rotation period fluctuation generated in sync with a gear engagement period. This is caused mainly by a unitary tooth pitch error, load fluctuation, and backlash resulting from a relationship to a moment of inertia. However, since the diameter of the follower reduction gear 11 is greater than the diameter of the photo conductor drum 1 as described above, the fluctuation due to the unitary tooth pitch error is small.

The second rotation period fluctuation is generated in one rotation of the motor. This is mainly caused by a transfer error due an accumulated tooth pitch error and eccentricity of the drive reduction gear 10. However, according to Embodiment 1, the rotation period of the drive reduction gear 10 is 1/N (N is a natural number) of a half-rotation period of the follower reduction gear 11. That is, if an angle between a line that goes from the center of the photo conductor drum rotation to an optical writing position and a line that goes from the center of the photo conductor drum rotation to an imprinting position is $\pi$, a fluctuation of the optical writing position and a fluctuation of the imprinting position are in the same phase, and the positioning error of an imprinted image is mitigated.

Nevertheless, only with the configuration described above, thickening (blur) of a pixel due to a speed difference between the imprinting medium conveyed by the conveyance belt and the photo conductor drum cannot be reduced. Accordingly, reducing the rotation period fluctuation as Embodiment 1 of the present invention practices is desired in order to improve the image quality. In addition, where the phase matching is provided as described above, an influence of the control error can be mitigated, and an error in measurement of the period fluctuation of the photo conductor drum can be mitigated. Further, in the case where the angle between the lines described above is not equal to $\pi$, the angle is made equal to an angle that is produced by a natural number times the rotations of the motor axle. Furthermore, according to Embodiment 1 of the present invention, a time during which a detection section is passed for detecting the photo conductor drum rotation period fluctuation is made equal to a natural number times the rotation period of the motor axle.

The third rotation period fluctuation is generated in one rotation of the photo conductor drum. This is mainly caused by a transfer error due to an accumulated tooth pitch error and tooth eccentricity of the follower reduction gear 11. Further, since the axle of the follower reduction gear 11 and the photo conductor drum axle 12 are connected with the couplers 9*b* and 9*c*, an axial center error and declination of both axles can be a cause.

Then, an attempt is made to detect the rotation period fluctuation generated in one rotation of the drum or the motor with a simple device and to compensate for the rotation period fluctuation, such as proposed by Patent Reference 5. FIG. 2 shows the configuration of detecting the rotation period fluctuation in one rotation of the drum (i.e., one rotation of the rotation axle 12). Here, the detector 14 (sensor) detects passages of the slits 13 (elements-to-be-detected), the passage time between slits is measured, and the rotation period fluctuation is determined. The pulse signal is arranged to fall (to an OFF state) at the time of slit passage such that a sharp pulse waveform can be obtained for improving detection accuracy.

At this time, it is necessary to detect a home position (rotation reference) in order to detect and compensate for the rotation period fluctuation. Conventionally, an element-to-be-detected corresponding to a pulse signal detected immediately after the motor velocity reaches a target velocity is made into the home position, and then a pulse counter is reset. Since the number of the elements-to-be-detected 13 in one rotation is known, the home position can be determined by continuously counting the number of pulses generated by the passage of the elements-to-be-detected 13. Here, the home position is determined, and compensation data corresponding to the home position are generated every time power is turned on. At this time, an element-to-be-detected 13 that serves as the home position is always recognized by a circuit or firmware. In this case, it is necessary to keep counting the number of the pulses in order to detect the home position. Further, depending on a rotational state, the home position may not be detected and rotation control cannot be started until the drum rotates nearly a full rotation. This poses a problem because the image formation apparatus is required to quickly start.

Figure 3:
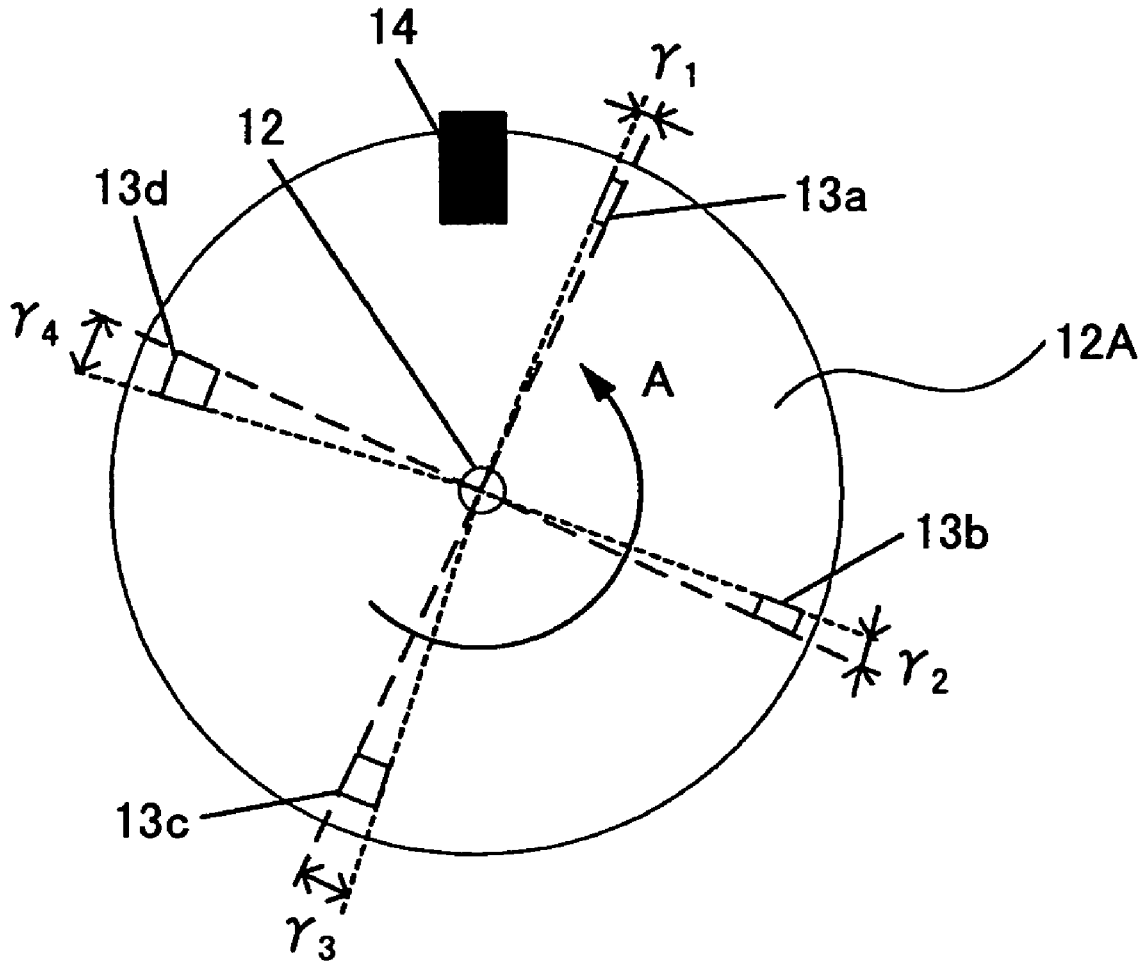
FIG. 3 is a schematic diagram of Embodiment 1 of the present invention in which slit widths are differentiated from each other so that a compensation reference position of a rotation period fluctuation can be detected.

The problem is solved by Embodiment 1 of the present invention, wherein a rotation reference can be quickly detected without a detector for exclusively detecting the rotational reference, within one rotation at the longest. The configuration and process of Embodiment 1 are described with reference to FIG. 3.

Figure 4:
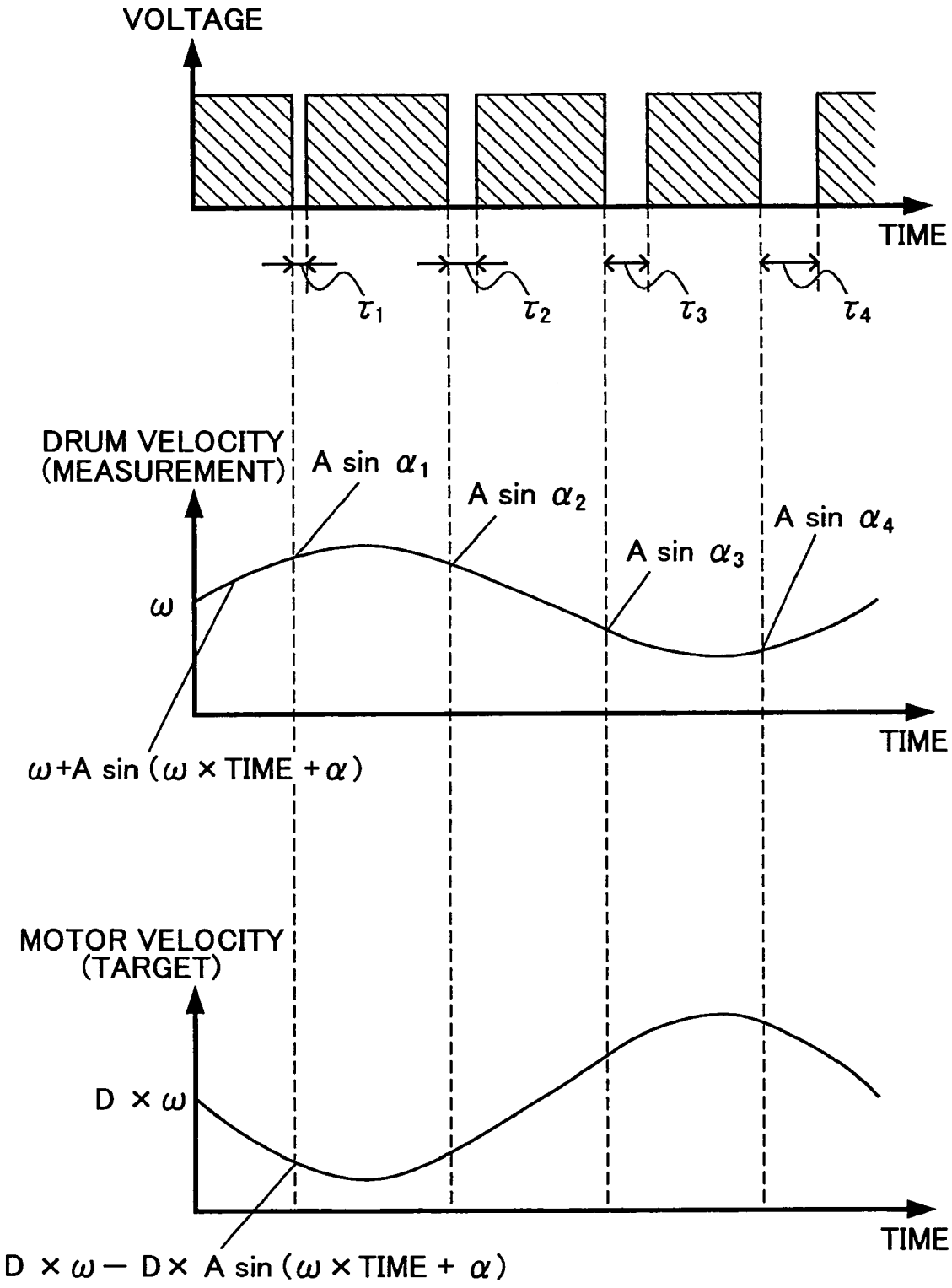

Four slits 13*a* through 13*d* are provided for detecting a rotation period fluctuation in one rotation of a drum, wherein the slits 13*a* through 13*d* have angular widths $\gamma_1$ through $\gamma_4$, respectively. The angular widths $\gamma_1$ through $\gamma_4$ are mutually different. Since change of the passage time due to the rotation period fluctuation is considered to be less than hundreds of μs, values of $\gamma_1$ through $\gamma_4$ are determined such that a difference in the magnitude of a few ms is obtained. In this way, by multiplying the target rotating velocity and the difference (in the magnitude of a few ms), a required angle difference can be determined. FIG. 4, at the top, gives a graph of pulse signals in the time domain, where pulse widths of the pulse signals (pulses) are $\tau_1$ through $\tau_4$; the pulses are generated when the corresponding slits are detected.

Since the pulse widths $\tau_1$ through $\tau_4$ are independent of an amount of the rotation period fluctuation, and they are always different from each other by several ms, each of the pulses can be identified with the pulse widths $\tau_1$ through $\tau_4$. A rotation period fluctuation is detected based on an interval between "falling" timings of the pulse signals. A graph in the middle of FIG. 4, identified by "Drum Velocity", shows correspondence between the pulse signal timing and a phase of the rotation period fluctuation. Here, ω is an average rotating velocity of the drum, A is the amplitude of the rotation period fluctuation, and $\alpha_1$ through $\alpha_4$ are phases of the rotation period fluctuation at each pulse signal "falling" timing. Here, according to Embodiment, the pulse signal falls at the time of slit passage (i.e., when the slit is detected); nevertheless, a configuration wherein the pulse signal rises at the time of slit passage is possible.

If the slits are arranged every 90°, then, $\alpha_1=\alpha_2-\pi/2=\alpha_3-\pi=\alpha_4-3\pi/2$. Accordingly, it is not necessary to store information about all the phases, but only the information about the phase $\alpha_1$ is stored as an absolute reference, and the rest can be calculated. In this way, storage space is saved. After detecting the rotation period fluctuation, the amplitude A and the phase $\alpha_1$ are stored. When the motor is started again, and a rotation control is carried out for reducing the rotation period fluctuation, the target velocity of the motor is updated as shown by a graph shown at the bottom of FIG. 4 (identified as "Motor Velocity") based on the stored information of the amplitude A and the phase $\alpha_1$. Here, D is a gear reduction ratio.

Figure 5:
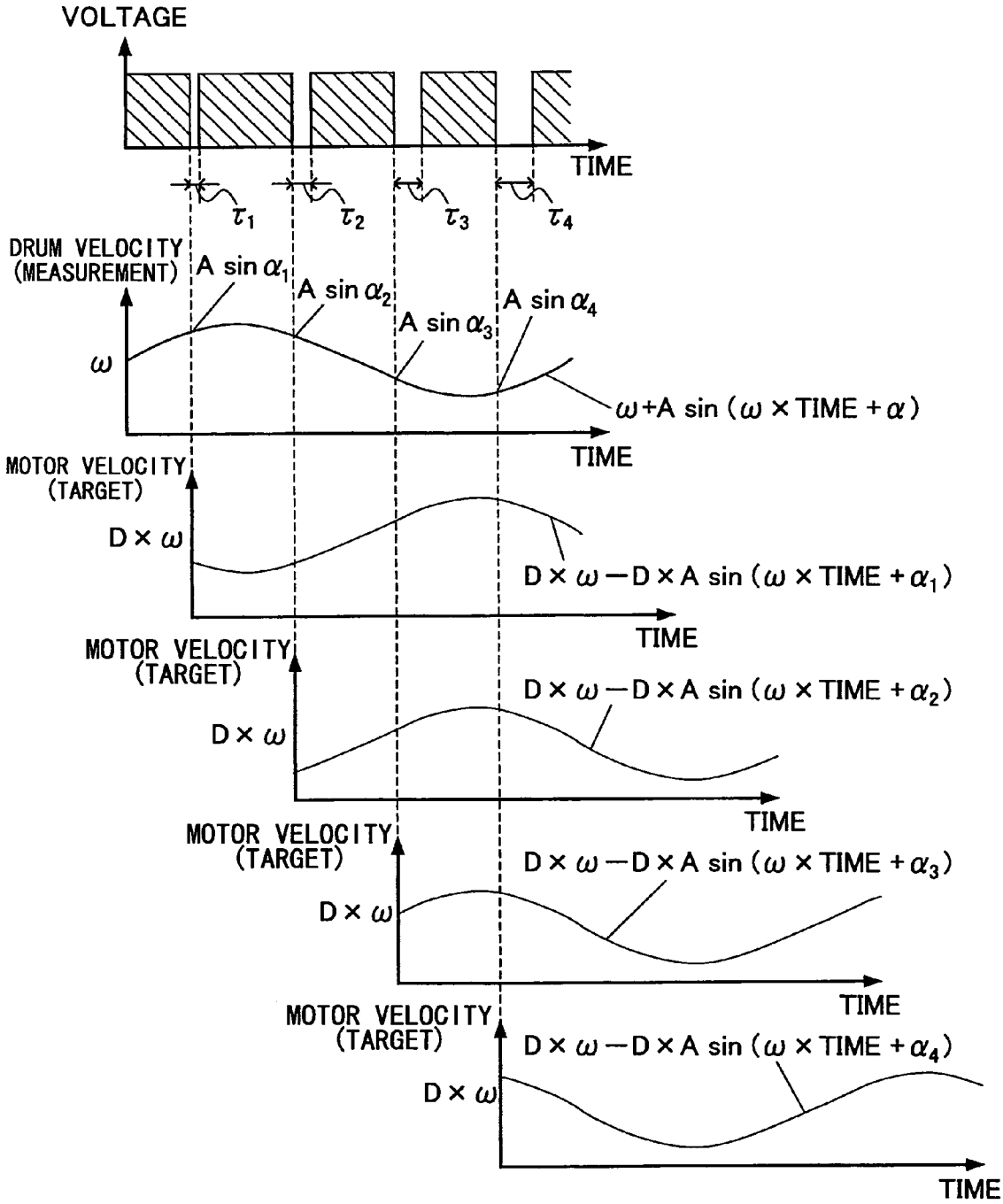
FIG. 5 gives graphs showing phase relations of the target motor velocity with reference to each reference in a configuration where the slit widths are different from each other.

In actual operations, when one of the four slits is detected after the motor reaches the original target velocity, a phase next to the slit that is detected is determined as shown in FIG. 5. Then, the rotation control is started with a time lag equivalent to ¼ rotation. That is, the rotation control is not started at the first detection of a slit after the motor reaches the target velocity. Here, in FIG. 3, the slits 13*a* through 13*d* are formed in a rotation plate 12A, and the rotation plate 12A is rotated in the direction of an arrow A.

Figure 6:
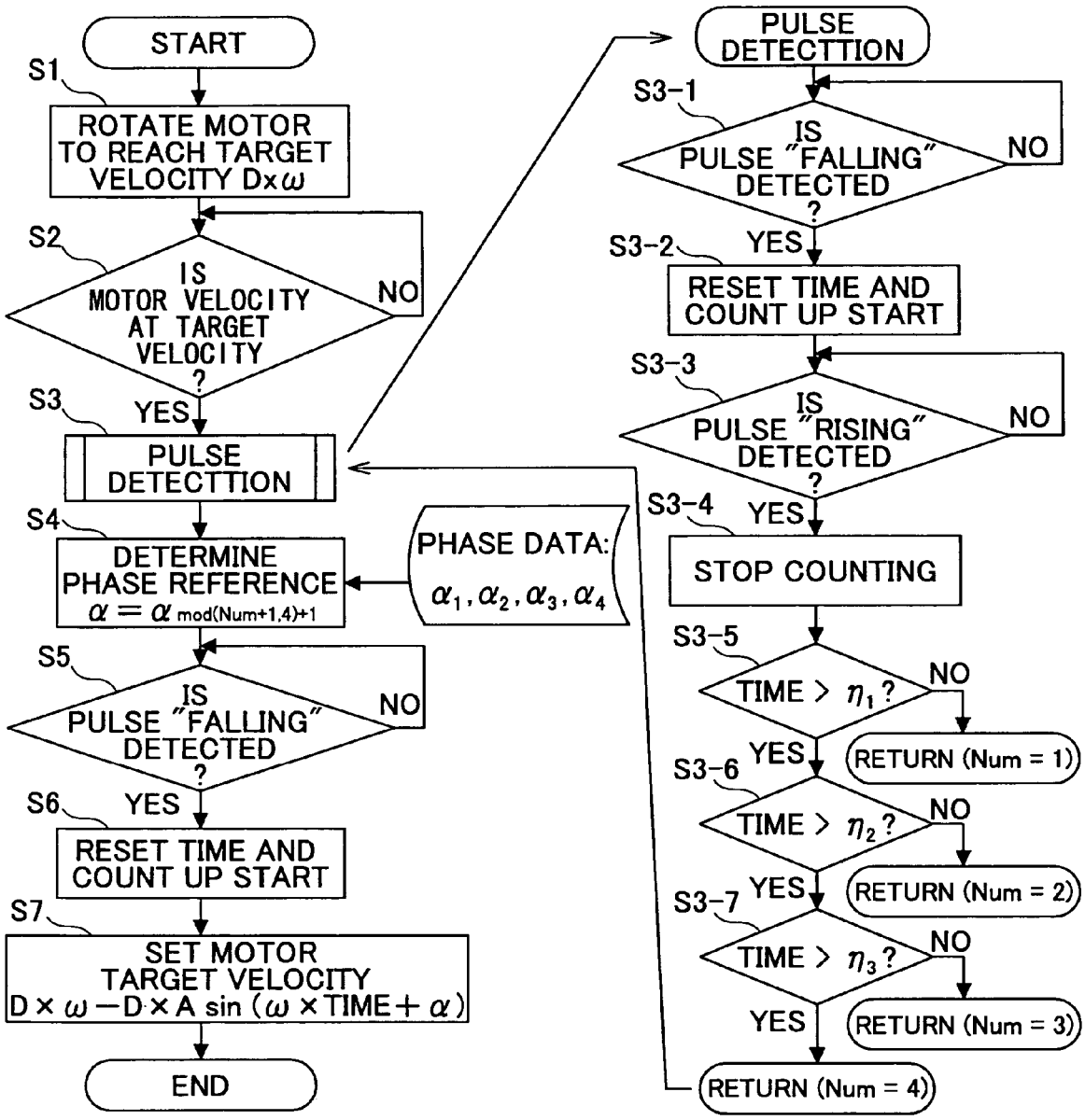
FIG. 6 is a flowchart of compensation start with the configuration where the slit widths are different from each other.

FIG. 6 is a flowchart of the process. For simplifying the description, it is presupposed that the rotation period fluctuation is beforehand detected, and that the amplitude A and the phase $\alpha_1$ of the rotation period fluctuation are beforehand stored. First, the motor is driven to reach the target velocity Dxω (step S1), and the rotating velocity of the motor is monitored (step S2). After the motor velocity reaches the target velocity, the process advances to a step of detecting the pulse signal (step S3).

Then, "falling" of the pulse signal is detected (step S3-1), a built-in timer counter is reset to 0, and count-up is started (step S3-2). If "rising" of the pulse signal is detected (step S3-3), timer count-up is stopped (step S3-4). Then, it is determined whether the measured timer count is greater than a predetermined value $\eta_1$ (step S3-5). The value $\eta_1$ takes a value between $\tau_1$ and $\tau_2$ that are expected from the average rotating velocity of the drum and the slit widths. If the measured timer count is less than $\eta_1$, it is determined that the slit 13*a* has passed, and a value Num is set to 1. If the measured timer count is greater than $\eta_1$, whether it is greater than a predetermined value $\eta_2$ is determined (step S3-6). The value $\eta_2$ takes a value between τ2 and τ3 that are expected from the average rotating velocity of the drum and the slit widths. If the measured timer count is less than $\eta_2$, it is determined that the slit 13*b* has passed, and the value Num is set to 2. If the measured timer count is greater than $\eta_2$, it is determined whether the measured timer count is greater than $\eta_3$ (step S3-7). The value $\eta_3$ takes a value between $\tau_3$ and $\tau_4$ that are expected from the average rotating velocity of the drum and the slit widths. If the measured timer count is less than $\eta_3$, it is determined that the slit 13*c* has passed, and the value Num is set to 3. Further, If the measured timer count is greater than $\eta_3$, it is determined that the slit 13*d* has passed, and the value Num is set to 4. Then, a phase α corresponding to the value Num is determined. Since the rotation control is started at a timing of a slit next to the slit that is detected at the step S3, the value Num is incremented by 1. For example, if the slit 13*a* (Num=1) is detected as passing at step S3, the phase α is set at $\alpha_2$ that corresponds to the value Num 2.

Further, if "falling" of the pulse signal is detected again (step S5), the timer counter is reset to 0 (step S6), the motor target velocity is immediately updated, and the rotation control is started (step S7). Although Embodiment 1 is described about the case wherein "falling" of the pulse signal is detected, an implementation wherein "rising" of the pulse signal is detected is possible.

Figure 7:
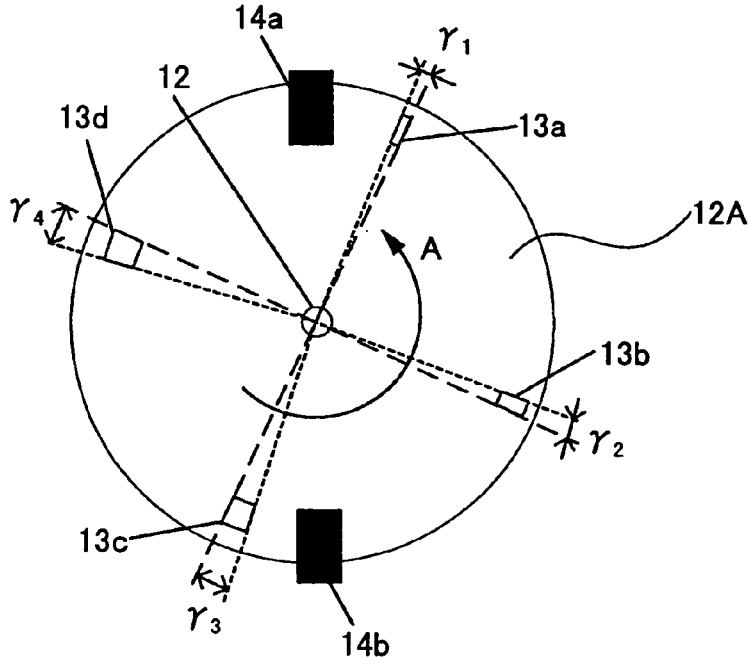
FIG. 7 is a schematic diagram of a configuration where the slit widths used for the compensation reference position of the rotation period fluctuation are different from each other, and two detectors are arranged.

Further, as shown in FIG. 7, it is possible to provide two detectors 14*a* and 14*b* symmetric to the rotation axle 12. In this case, eccentricity of the rotation plate 12A with reference to the rotation axle 12 can be removed. One of the detectors

14*a* and 14*b* is assigned to be the master sensor for detecting the rotation reference, and the same process as described above is carried out.

Embodiment 2

Figure 8:
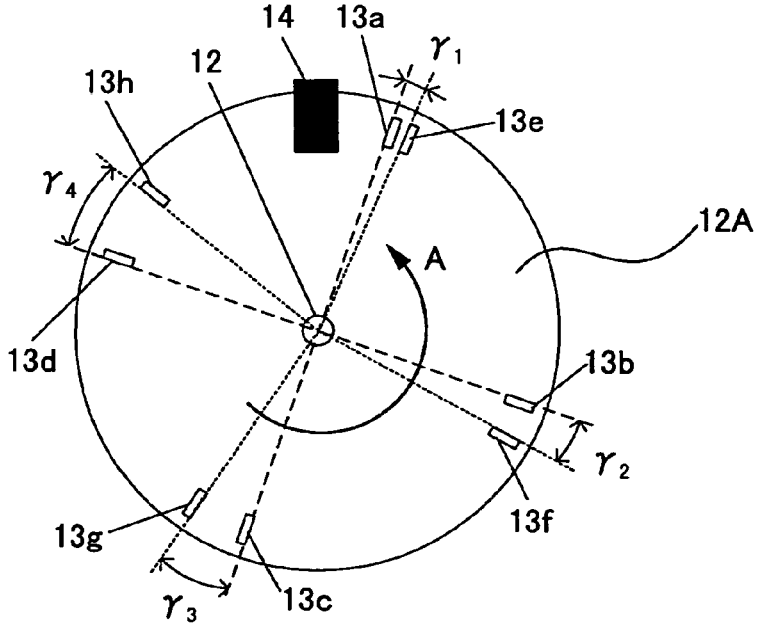
FIG. 8 is a schematic diagram of Embodiment 2 of the present invention, where slit pairs are used for determining a compensation reference position, wherein a distance between the two slits of each of the pairs is different from others, and a first slit serves as a compensation reference position.

In Embodiment 1, the information on the rotation position is acquired by differentiating the widths of the four slits. However, mechanical strength tends to be degraded around the slit(s) having a greater width, and different tools are required to make different widths of the slits. In view of this, Embodiment 2 provides a configuration and a process wherein detection of the rotation period fluctuation and the rotation reference are carried out without differentiating the slit widths as described below with reference to FIG. 8. In addition to the slits 13*a* through 13*d* for detecting the rotation period fluctuation, slits 13*e* through 13*h* are additionally arranged immediately after the slits 13*a* through 13*d*, respectively.

Figure 9:
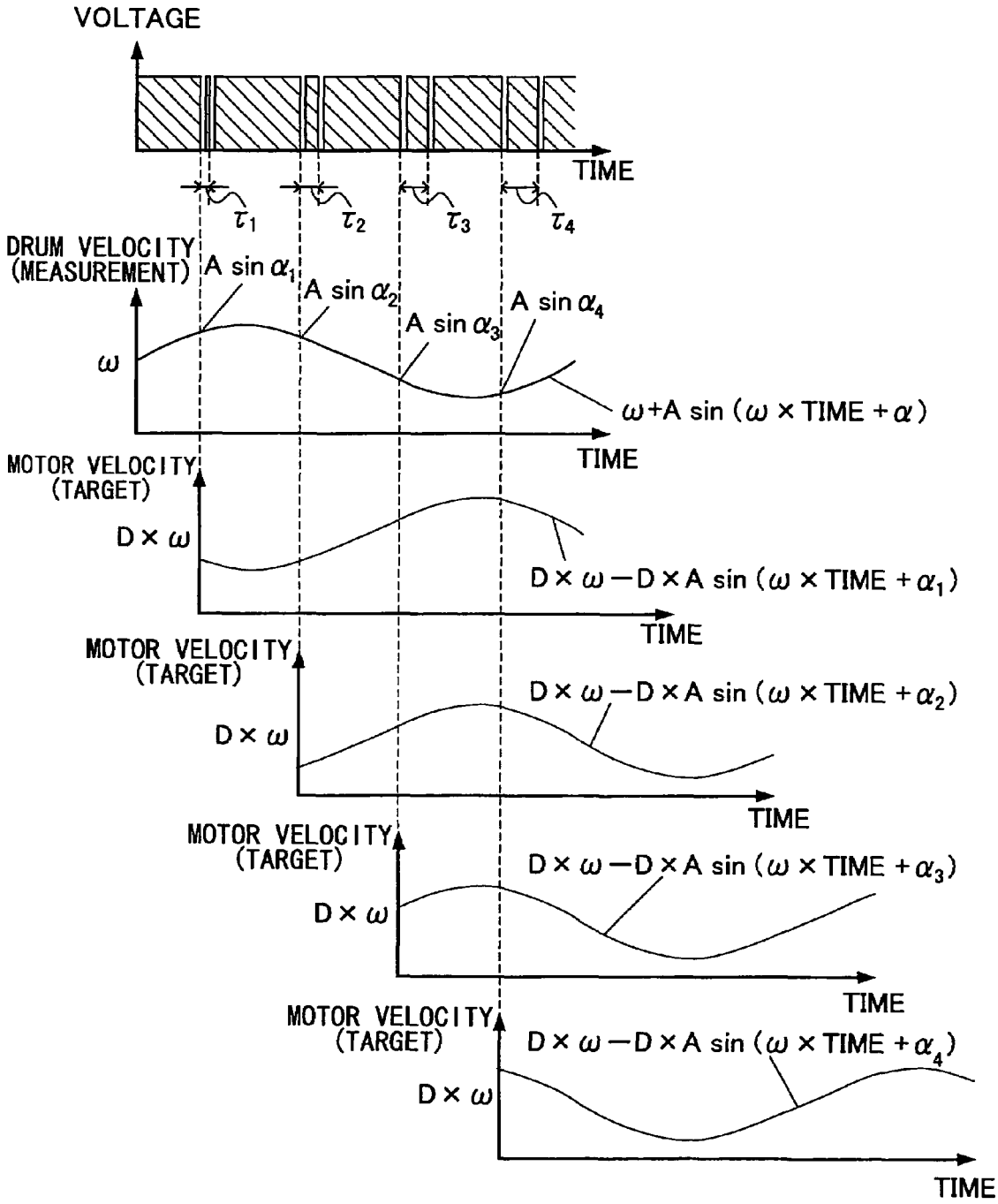
FIG. 9 gives graphs showing phase relationships of the target motor velocity with reference to each reference in the configuration where the slit pairs are used, and where the first slit is used as the compensation reference.

FIG. 9 gives graphs that show relationships between the pulse signals of slit detection and the rotation period fluctuation. According to Embodiment 1, the times $\tau_1$ through $\tau_4$ during which the pulse signals are turned off are differentiated, and the rotation reference position is determined based on the differentiated times. In contrast, according to Embodiment 2, the rotation reference is determined based on an interval between times of "falling" of adjoining pulse signals.

Figure 10:
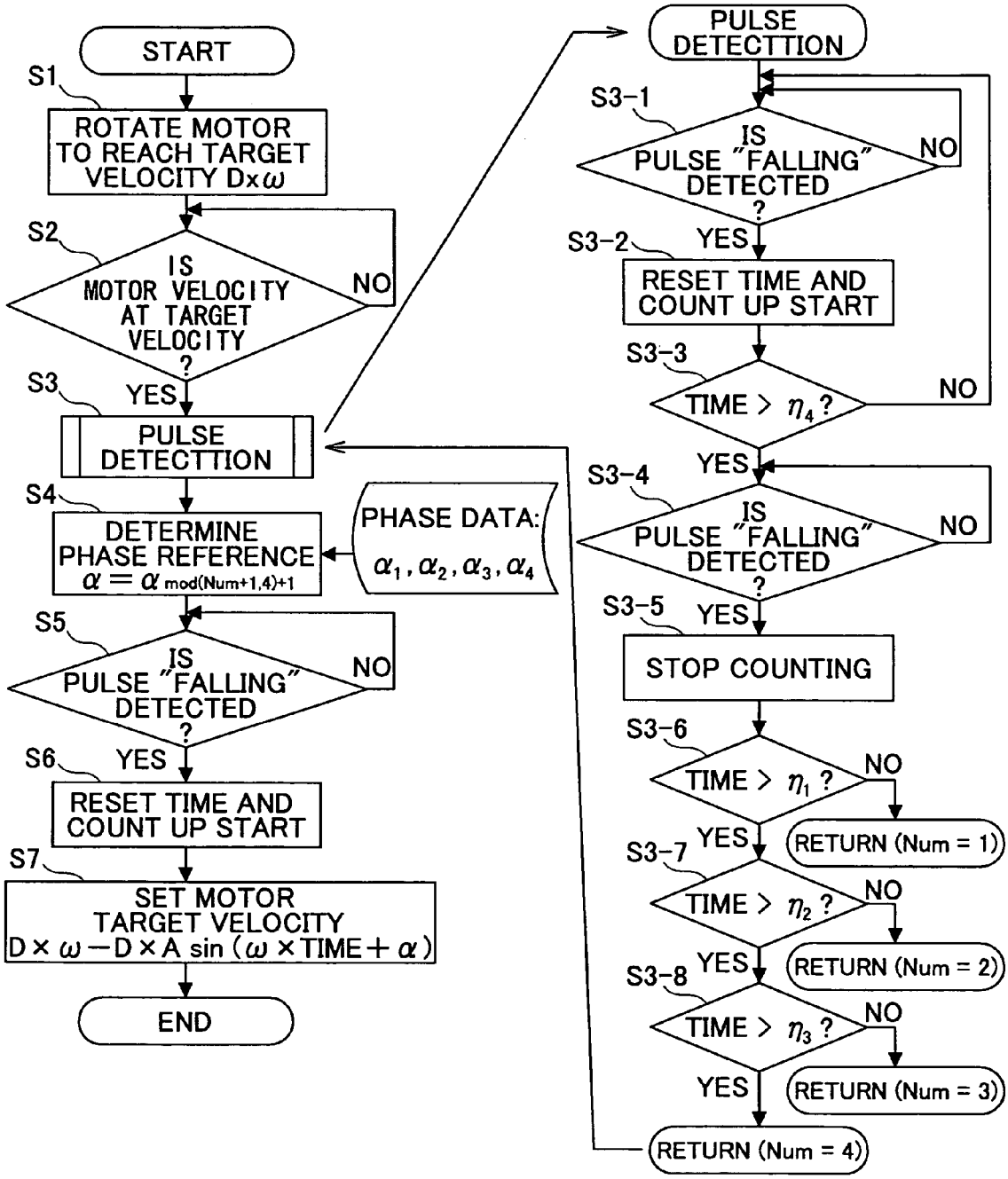
FIG. 10 is a flowchart of the compensation start in the case that the slit pairs are used, and the first slit serves as the compensation reference.

FIG. 10 is a flowchart showing the process of Embodiment 2. As compared with FIG. 6, the steps S3-4 and S3-3 are different between the two Embodiments. Accordingly, the following descriptions give details of the difference. After detecting "falling" of the pulse signal (step S3-1) and starting timer count-up (step S3-2), it is determined whether the timer value exceeds the value $\eta_4$ (step S3-3). The value $\eta_4$ is set to $\tau_4$ that is expected from the average rotating velocity of the drum and the slit width. The step S3-3 is to ensure that the interval between, for example, 13*a* and 13*e* is measured, removing a possibility of measuring a wrong interval between, for example, 13*e* and 13*b*. Then, a first "falling" of the pulse signal is detected; and then, if a second "falling" of the pulse signal is detected within the time $\eta_4$ from the first "falling" of the pulse signal (step S3-4), timer count-up is stopped (step S3-5). In this way, the slits having the same width realize a high-speed detection of the rotation reference with the greatest time delay of ¼ rotation.

Embodiment 2 can be realized with the two detectors 14*a* and 14*b* that are symmetrically arranged to the rotation axle 12 as shown in FIG. 7.

Embodiment 3

As described above, Embodiment 2 is capable of detecting the rotation period fluctuation in one rotation of the drum with eight slits, and capable of starting the rotation control with at the greatest ¼ time lag. Embodiment 3 is for further reducing the time delay associated with detecting the rotation period fluctuation in one rotation of the drum. Embodiment 3 is described with reference to FIG. 11. Here, a difference of Embodiment 3 from Embodiment 2 is that the slits 13*e* through 13*h* are for detecting the rotation period fluctuation, and the slits 13*a* through 13*d* are detected before the slits 13*e* through 13*h*, respectively.

Figure 12:
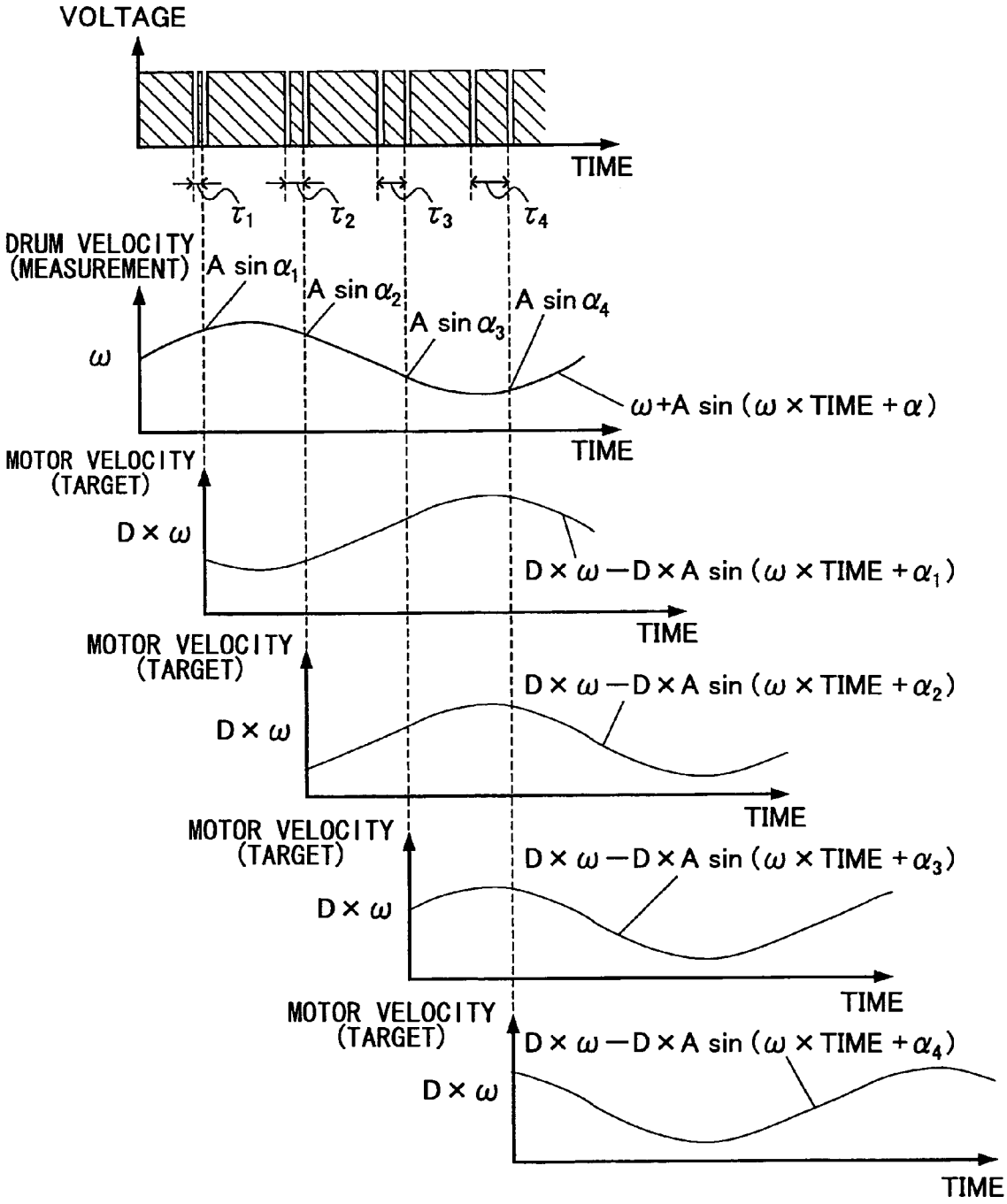
FIG. 12 gives graphs showing phase relationships of the target motor velocity with reference to each reference in the configuration where the slit pairs are used, and where the second slit serves as the compensation reference.

FIG. 12 gives graphs showing relationships between the pulse signal of slit detection and the rotation period fluctuation. According to Embodiment 2, the interval between two "falling" adjacent pulse signals is measured, and the phase $\alpha$ of the rotation reference is determined when the next pulse signal is detected. According to Embodiment 3, when "falling" of the pulse signal is first detected, the phase $\alpha$ of the rotation reference starts to be sequentially updated as the time lapses. Then, when "falling" of the pulse signal is detected for the second time, the motor rotation target velocity is updated with the phase $\alpha$ at that time, and the rotation control is started.

Figure 13:
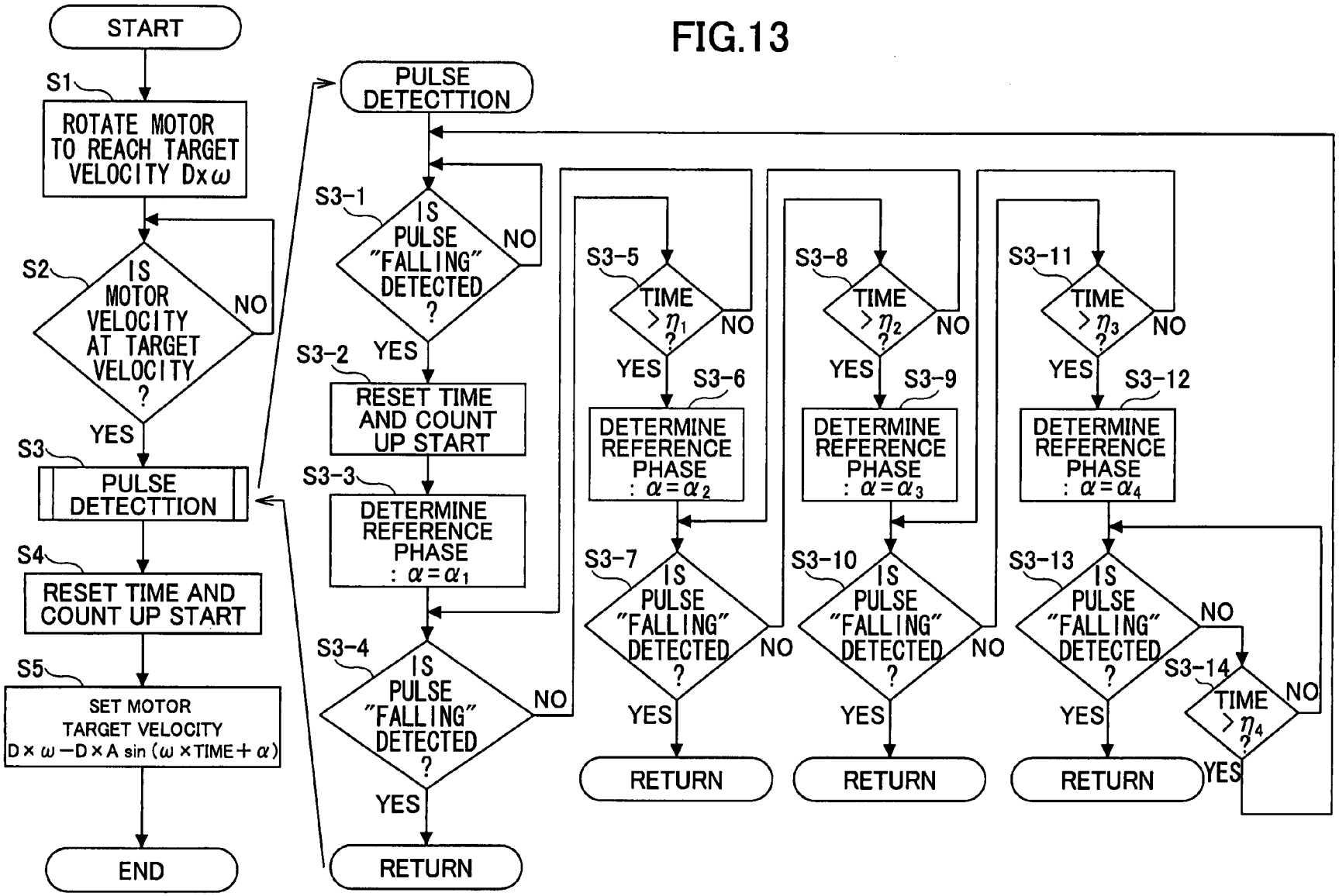
FIG. 13 is a flowchart of the compensation start in the case that the slit pairs are used, and the second slit serves as the compensation reference.

FIG. 13 is a flowchart showing the process of Embodiment 3. For simplifying the description, it is presupposed that the rotation period fluctuation is beforehand detected, and that the amplitude A and the phase $\alpha_1$ ($\alpha_2$, $\alpha_3$, $\alpha_4$) of the rotation period fluctuation are beforehand stored. First, the motor is started to reach the target velocity Dx$\omega$ (step S1), and the rotating velocity of the motor is monitored (step S2). When the motor velocity reaches the target velocity, the process proceeds to the step S3 of detecting a pulse signal (step S3). If "falling" of the pulse signal is detected (step S3-1), the built-in timer counter is reset to 0, and count-up is started (step S3-2). Then, the phase $\alpha$ of the rotation reference is set to $\alpha_1$ (step S3-3) . Here, $\alpha_1$ corresponds to $\xi_1$ in FIG. 11, which is the smallest angle in slit spacing set up as a phase of the rotation reference. This corresponds to the pulse signal that has the width $\tau_1$ in FIG. 12. When next "falling" of the pulse signal is detected (step S3-4), the timer counter is reset to 0 (step S4), the motor target velocity is immediately updated, and the rotation control is started (step S5).

Here, if no "falling" of the pulse signal is detected, and if the timer value is determined to be greater than $\eta_1$ (step S3-5), the phase $\alpha$ of the rotation reference is set at $\alpha_2$ (step S3-6). Here, $\alpha_2$ corresponds to $\xi_2$, the second smallest angle next to $\xi_1$ in the slit spacing set up as the phase of the rotation reference in FIG. 11. This is equivalent to the pulse signal width of $\tau_2$ in FIG. 12. If "falling" of the pulse signal is detected again (step S3-7), the timer counter is reset to 0 (step S4), the motor target velocity is immediately updated, and the rotation control is started (step S5).

Further, if no "falling" of the pulse signal is detected, and if the timer value is determined to be greater than $\eta_2$ (step S3-8), the phase $\alpha$ of the rotation reference is set up at $\alpha_3$ (step S3-9). Here, $\alpha_3$ corresponds to $\xi_3$, the next greater than $\xi_2$ in the slit spacing set up as the phase of the rotation reference in FIG. 11. This is equivalent to the pulse signal width $\tau_3$ in FIG. 12. If "falling" of the pulse signal is detected (step S3-10), the timer counter is reset to 0 (step S4), the motor target velocity is immediately updated, and the rotation control is started (step S5).

If no "falling" of the pulse signal is detected, and if the timer value is determined to be greater than $\eta_3$ (step S3-11), the phase $\alpha$ of the rotation reference is set up at $\alpha_4$ (step S3-12). Here, $\alpha_4$ corresponds to $\xi_4$, the greatest in the slit spacing set up as the phase of the rotation reference in FIG. 11. This is equivalent to the pulse signal width $\tau_4$ in FIG. 12. If "falling" of the pulse signal is detected (step S3-13), the timer counter is reset to 0 (step S4), the motor target velocity is immediately updated, and the rotation control is started (step S5).

If no "falling" of the pulse signal is detected, and if the timer value is determined to be greater than $\eta_4$ (step S3-14), the process returns to the step S3-1. This is to correctly consider an interval such as between 13*a* and 13*e* of FIG. 11, removing the possibility of considering a wrong interval, such as between 13*e* and 13*b*, as described with reference to Embodiment 2.

Here, the slit intervals $\xi 1$ through $\xi 4$ are defined by an integral multiple of one rotation period of the motor so that an influence to the detection of the rotation period fluctuation of the motor is removed.

As described above, according to Embodiment 3, the rotation control can be started when the second slit is passing (detected); this contrasts with Embodiment 2 described above where the rotation control is started at the third slit passage.

Embodiment 3 can be implemented with the two detectors 14*a* and 14*b* symmetrically arranged on the rotation axle 12 as shown in FIG. 7.

Embodiment 4

Figure 11:
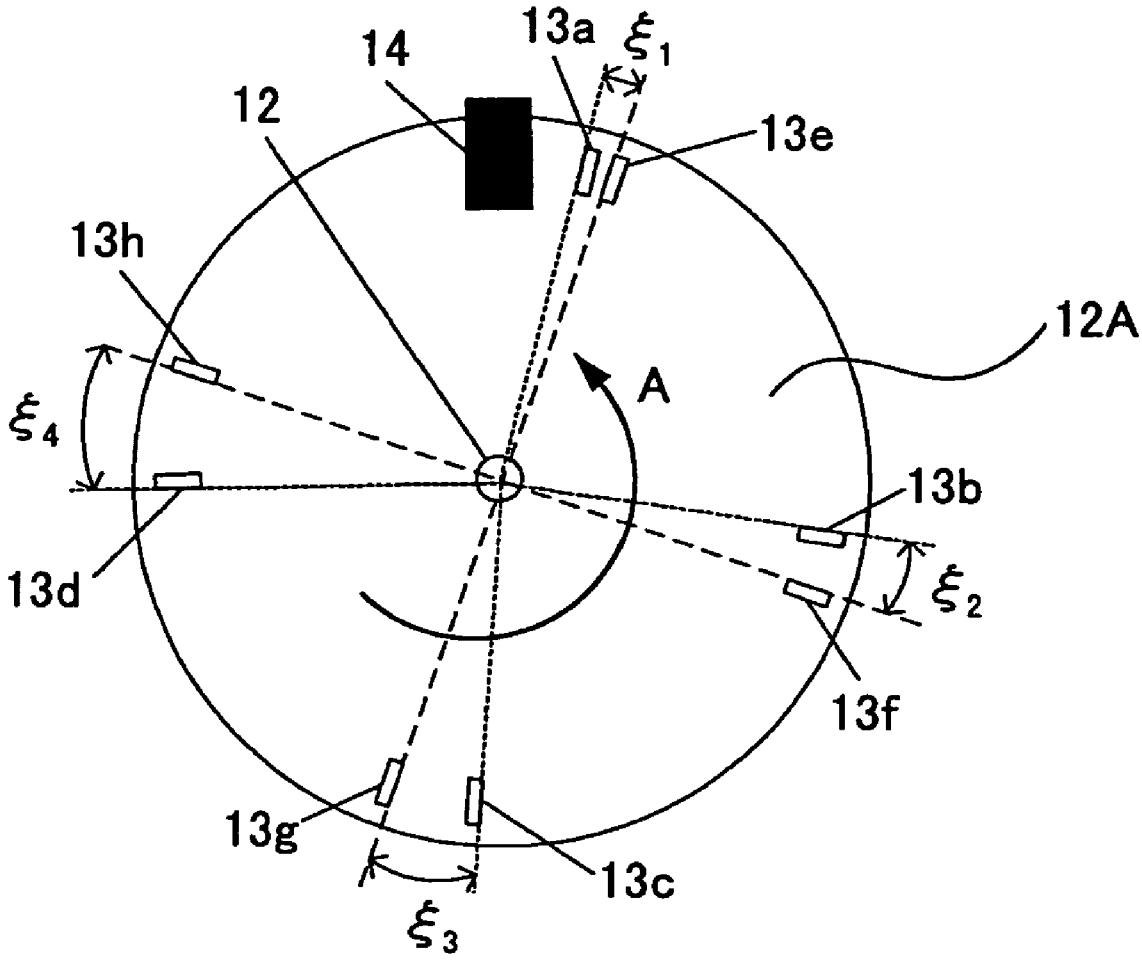
FIG. 11 is a schematic diagram of Embodiment 3 of the present invention, wherein pairs of slits are used for determining a compensation reference position, wherein the interval between two slits of each of the pairs is different from others, and a second slit serves as the compensation reference position.
Figure 14:
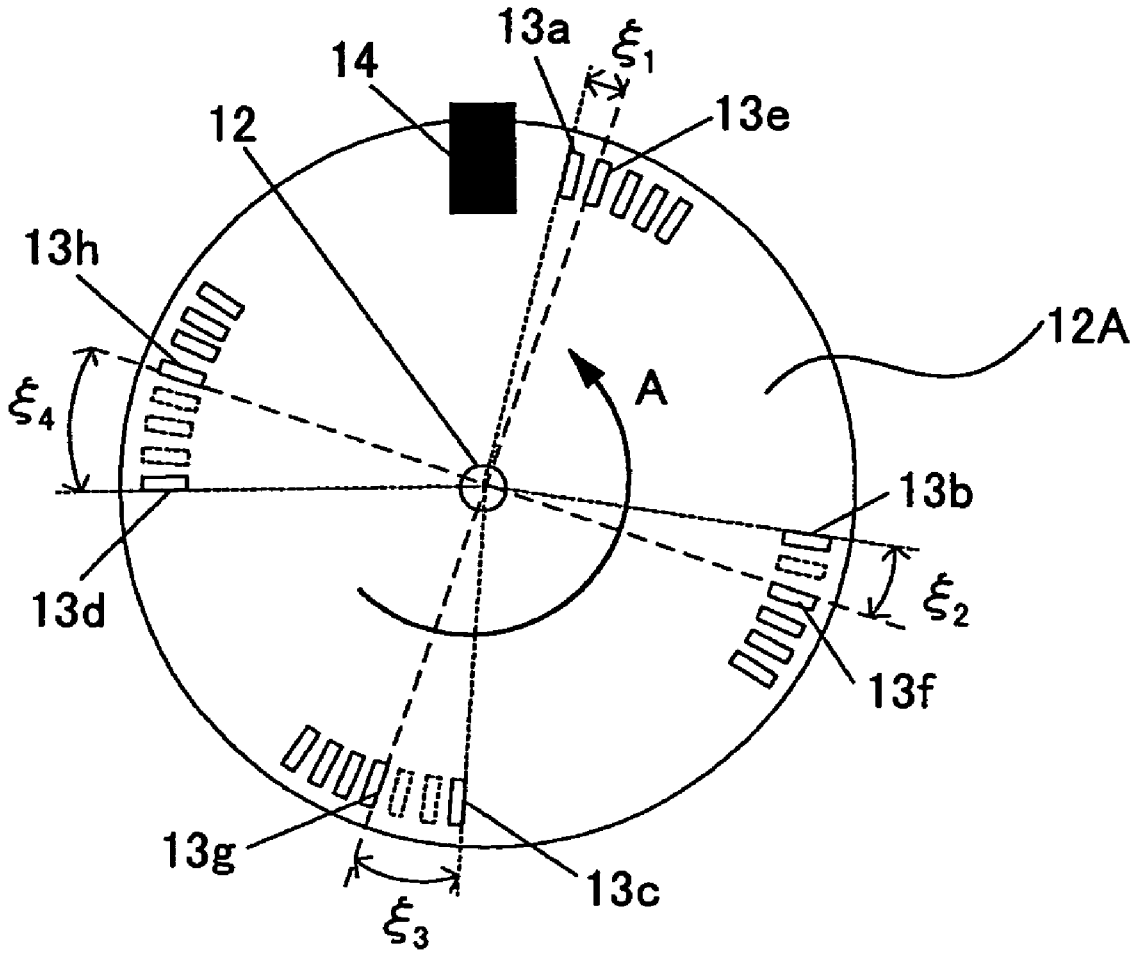
FIG. 14 is a schematic diagram of Embodiment 4 of the present invention, where two or more compensation reference slits are provided; the slits are also for determining the rotation period fluctuation.

Embodiment 4, wherein the rotation control can be started at the time of the second slit passage, is described with reference to FIG. 14. According to Embodiment 4, the rotation reference is detected for compensating for not only the rotation period fluctuation in one rotation of the drum, but also the rotation period fluctuation in one rotation of the motor. As shown in FIG. 14, three slits follow each of the slits 13*e* through 13*h* for detecting the rotation period fluctuation in one rotation of the drum in addition to what are shown in FIG. 11. The additional three slits are arranged at equal intervals starting from the corresponding slits 13*e* through 13*h*. Further, the slits 13*a* through 13*d* that are detected in advance of the slits 13*e* through 13*h*, respectively, are provided. In order to detect the rotation period fluctuation in one rotation of the motor, it is necessary to obtain an average rotating velocity of the motor. Generally, e.g. four groups each consisting of five slits are arranged at regular intervals e.g., every 90°, and the time of one rotation of the motor is determined based on a time taken by passage between both ends. However, here in Embodiment 4, an interval between the slits 13*a* through 13*d* and the slits 13*e* through 13*h*, respectively, is made an integral multiple of ¼ rotational period of the motor; accordingly, a passage time of one rotation of the motor can be measured by measuring the passage time between the slit 13*a* and the third slit after the slit 13*e*, the passage time between the slit 13*b* and the second slit after the slit 13*f*, the passage time between the slit 13*c* and the first slit after the slit 13*g*, and the passage time between the slit 13*d* and the slit 13*h*. In this way, the number of slits to be processed is reduced.

Figure 15:
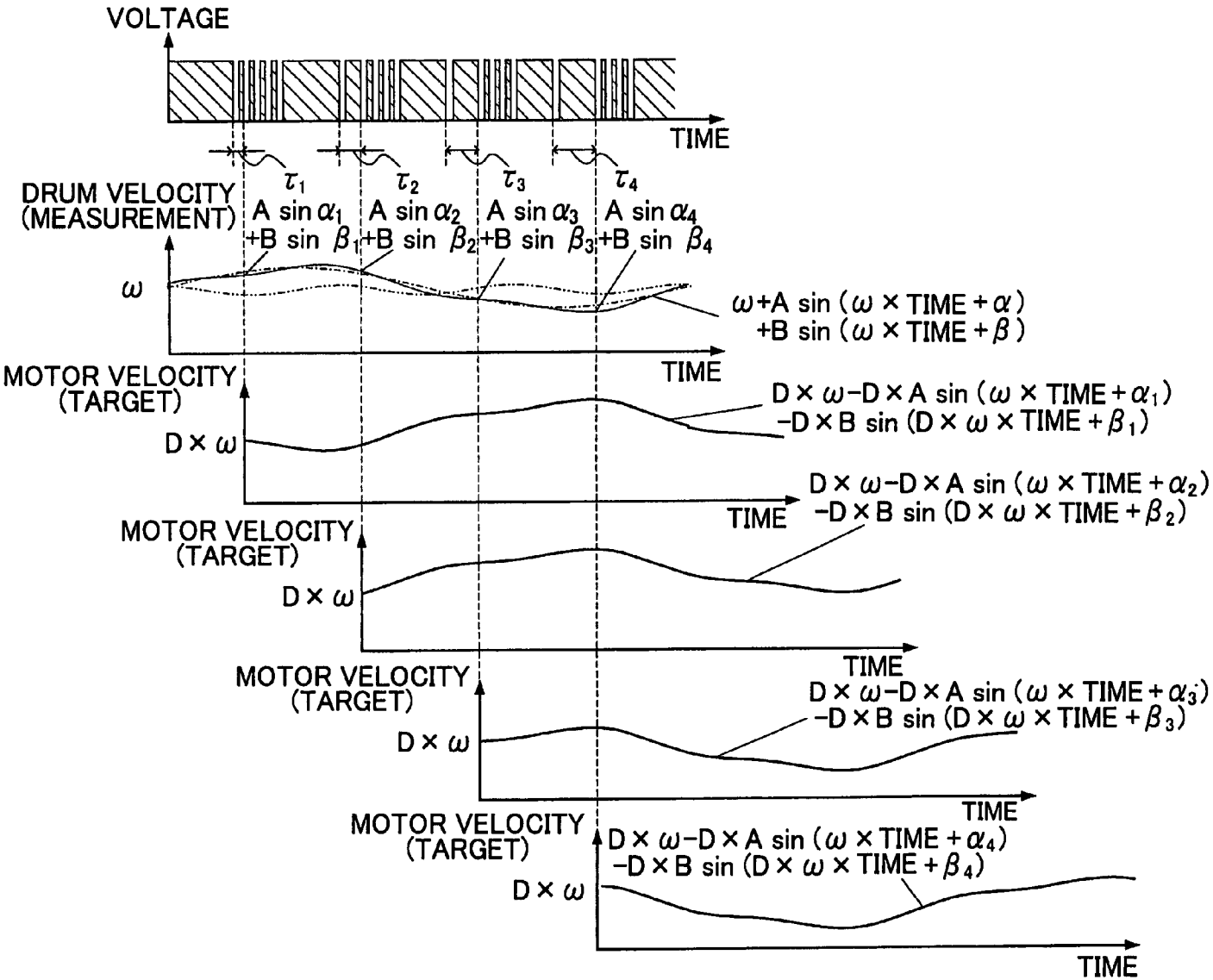
FIG. 15 gives graphs showing phase relationships of the target motor velocity with reference to each reference where there are two {three?} or more compensation reference slits that are also for {determining} the rotation period fluctuation.

FIG. 15 gives graphs showing relationships between the pulse signal of slit detection and the rotation period fluctuation. At the top of FIG. 15, the pulse signals generated when slits are passed (detected) are shown in the time domain. Since the times $\tau_1$ through $\tau_4$ are different from each other by several ms, and are independent of the amount of rotation period fluctuation, the pulses can be distinguished based on the time difference. The rotation period fluctuation is detected based on an interval between two adjacent "falling" occasions of the pulse signals.

The graphs in the middle of FIG. 15 show relationships between the timings of the pulse signals and the phases of the rotation period fluctuation. Here, $\omega$ is the average rotating velocity of the drum, A is the amplitude of the rotation period fluctuation in one rotation of the drum, and $\alpha_1$ through $\alpha_4$ are the phases of the rotation period fluctuation in one rotation of the drum at each "falling" timing of the pulse signal. Further, B is the amplitude of the rotation period fluctuation in one rotation of the motor, and $\beta_1$ through $\beta_4$ are the phases of the rotation period fluctuation in one rotation of the motor at corresponding "falling" timings of the pulse signals. If the slits 13*e* through 13*h* are arranged at every 90°, $\alpha_1=\alpha_2-\pi/2=\alpha_3-\pi=\alpha_4-3\pi/2$. Accordingly, in this case, it is not necessary to store all the phases, but only the phase $\alpha_1$, which serves as an absolute reference, is stored, and the remainder can be calculated. In this way, the storage space is saved. Further, by arranging the additional slits following each of the slits 13*e* through 13*h* at an interval equal to an integral multiple of ¼ rotation of the motor, $\beta_1=\beta_2-Dx\pi/2=\beta_3-Dx\pi=\beta_4-Dx3\pi/2$ is obtained. Accordingly, not all phases have to be stored, but only the phase of $\beta_1$, which serves as the absolute reference, is stored, and the remainder can be calculated. In this way, the storage space for storing the phases of the rotation period fluctuation in one rotation of the motor can be saved.

Figure 16:
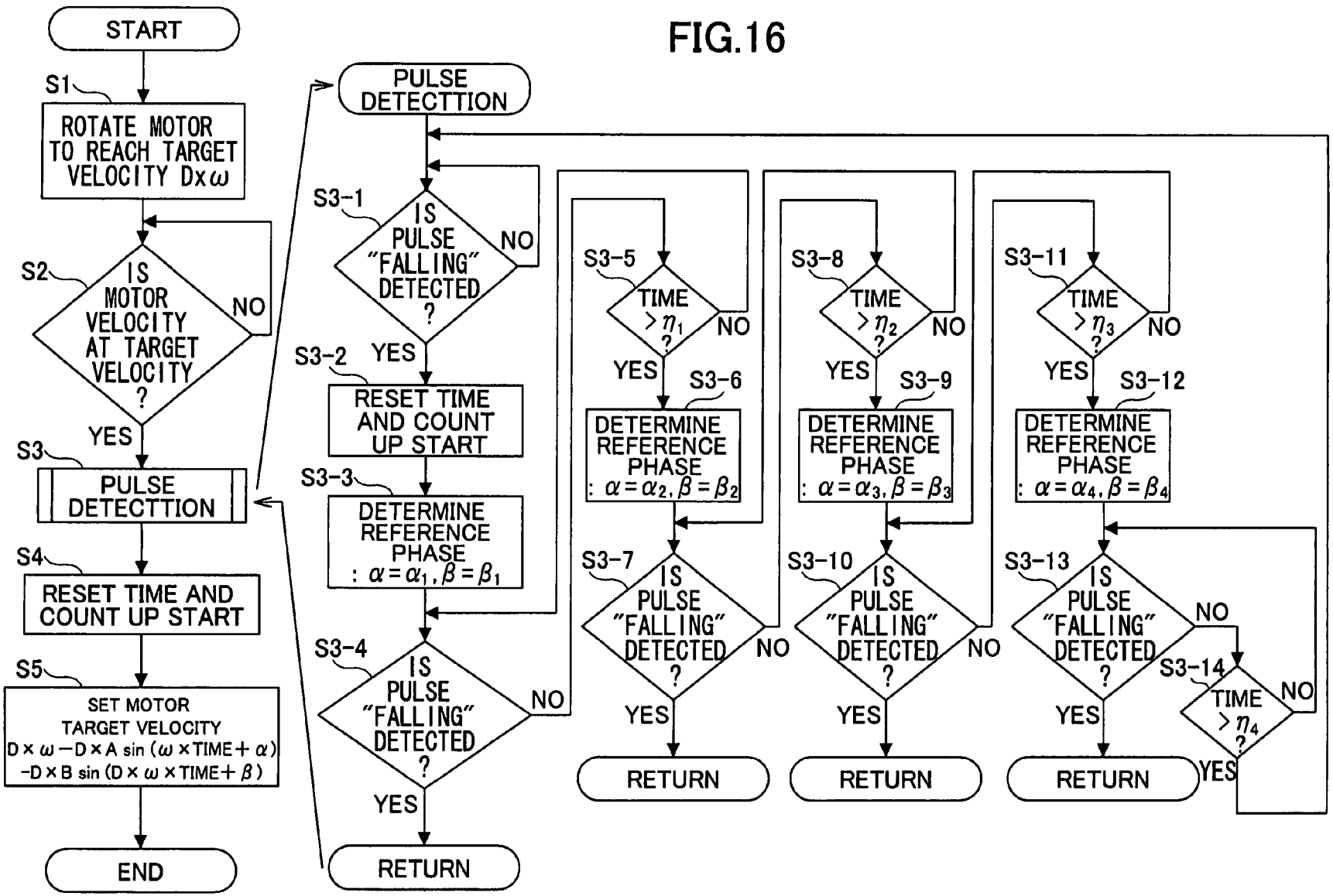
FIG. 16 is a flowchart of the compensation start where two or more compensation reference slits are provided; the slits are also for determining the rotation period fluctuation.

FIG. 16 is a flowchart of the process of Embodiment 4. For simplifying the description that follow, it is presupposed that the rotation period fluctuation is beforehand detected; namely, the amplitude A and the phase $\alpha_1$ ($\alpha_2$, $\alpha_3$, $\alpha_4$) of the rotation period fluctuation in one rotation of the drum are stored; further, the amplitude B and the phase $\beta_1$ ($\beta_2$, $\beta_3$, $\beta_4$) of the rotation period fluctuation in one rotation of the motor are stored. First, the motor is started to reach the target velocity $Dx\omega$ (step S1), and the rotating velocity of the motor is monitored (step S2). After the motor velocity reaches the target velocity, the process proceeds to the step S3 of detecting the pulse signal. If "falling" of the pulse signal is detected (step S3-1), the built-in timer counter is reset to 0, and count-up is started (step S3-2). Then, the phases $\alpha$ and $\beta$ of the rotation reference are set up at $\alpha_1$ and $\beta_1$, respectively (step S3-3). Here, $\alpha_1$ corresponds to the angle $\xi 1$ that is the smallest of slit intervals set up as the phase of the rotation reference in FIG. 14; and $\beta_1$ corresponds to $\alpha_1$. Further, $\alpha_1$ and $\beta_1$ correspond to $\tau_1$ that is the interval between two "falling" occasions of the pulse signals in FIG. 15. If "falling" of the pulse signal is detected again (step S3-4), the timer counter is reset to 0 (step S4), the motor target velocity is immediately updated, and the rotation control is started (step S5).

Here, if no "falling" of the pulse signal is detected, and if the timer value is greater than $\eta_1$ (step S3-5), the phases $\alpha_1$ and $\beta_1$ of the rotation references are set up at $\alpha_2$ and $\beta_2$, respectively (step S3-6). Here, $\alpha_2$ corresponds to $\xi_2$ that is the second smallest to $\xi_1$ of the slit spacing set up as the phase of the rotation reference in FIG. 14; and $\beta_2$ corresponds to $\alpha_2$. They correspond to the pulse signal spacing width $\tau_2$ in FIG. 15. If the "falling" of the pulse signal is detected again (step S3-7), the timer counter is reset to 0 (step S4), the motor target velocity is immediately updated, and the rotation control is started (step S5).

Furthermore, if no "falling" of the pulse signal is detected, and if the timer value is greater than $\eta_2$ (step S3-8), the phases $\alpha_1$ and $\beta_1$ of the rotation reference are set up at $\alpha_3$ and $\beta_3$, respectively (step S3-9). Here, $\alpha_3$ corresponds to $\xi_3$ that is the third smallest next to $\xi_2$ in the slit spacing set up as the phase of rotation reference in FIG. 14; and $\beta_3$ corresponds to $\alpha_3$. They correspond to the pulse signal spacing width $\tau_3$ in FIG. 15. If the "falling" of the pulse signal is detected again (step S3-10), the timer counter is reset to 0 (step S4), the motor target velocity is immediately updated, and the rotation control is started (step S5).

If no "falling" of the pulse signal is detected, and if the timer value is greater than $\eta_3$ (step S3-11), the phases $\alpha_1$ and $\beta_1$ of the rotation reference are set up at $\alpha_4$ and $\beta_4$, respectively (step S3-12). Here, $\alpha_4$ corresponds to $\xi_4$ that is the greatest of the slit spacing set up as the phase of rotation reference in FIG. 14; and $\beta_4$ corresponds to $\alpha_4$. They correspond to the pulse signal spacing width $\tau_4$ in FIG. 15. If the "falling" of the pulse signal is detected again (step S3-13), the timer counter is reset to 0 (step S4), the motor target velocity is immediately updated, and the rotation control is started (step S5).

If no "falling" of the pulse signal is detected, and the timer value is greater than $\eta_4$ (step S3-14), the process goes to the step S3-1. This is to ensure detecting a correct interval, e.g., between 13*a* and 13*e* of FIG. 14, and to remove the possibility of detecting a wrong interval, e.g., between 13*e* and 13*b*, as described in Embodiment 2.

With the case of the 4-color tandem type color printer as shown in FIG. 1, if the phases of the rotation period fluctuations in one rotation of the photo conductor drums are to be aligned, data of the rotation period fluctuation in one rotation of the motor are not used. But rather, one of the photo conductor drums is assigned as a reference; and the phases of the rotation reference of the rotation period fluctuation of the remaining three photo conductor drums are aligned to the phase of the rotation period fluctuation of the reference photo conductor drum.

Embodiment 4 may be implemented with the two detectors 14*a* and 14*b* symmetrically arranged to the rotation axle 12 as shown in FIG. 7.

EFFECTIVENESS OF INVENTION

The embodiments of the present invention provide the rotor drive controlling unit that is capable of quickly detecting the reference and quickly starting the rotation control, and the image formation apparatus including the rotor drive controlling unit.

Further, the present invention is not limited to these embodiments, but variations and modifications may be made without departing from the scope of the present invention.

The present application is based on Japanese Priority Application No. 2005-344268 filed on Nov. 29, 2005 with the Japanese Patent Office, the entire contents of which are hereby incorporated by reference.

What is claimed is:

1. A rotor drive controlling unit, comprising:

a motor;

a transfer device for transferring a rotational force of the motor;

a rotor connected to the transfer device and rotated by the rotational force of the motor;

at least three elements-to-be-detected arranged on a periphery centered on a rotation axle of the rotor;

a detector for detecting the elements-to-be-detected;

a passage time detecting unit for detecting an interval between adjacent elements-to-be-detected passing the detector based on detecting signals generated by the detector;

an amplitude/phase generating unit for generating an amplitude and a phase of a rotation period fluctuation of a desired period of the rotor based on the interval detected by the passage time detecting unit;

a rotation controlling unit for controlling rotation of the motor based on the amplitude and the phase generated by the amplitude/phase generating unit and for reducing the rotation period fluctuation; and a control reference updating unit for updating the phase, at which updated phase a rotation control of the motor is started, based on the phase generated by the amplitude/phase generating unit with reference to the elements-to-be-detected when widths of the at least three elements-to-be-detected mutually differ.

2. The rotor drive controlling unit as claimed in claim 1, wherein the interval detected by the passage time detecting unit is a half period of the rotation period fluctuation about the desired period of the rotor, and a phase difference of adjacent intervals is shifted by one quarter period of the rotation period fluctuation.

3. The rotor drive controlling unit as claimed claim 1, wherein the control reference updating unit, using the amplitude/phase generating unit, sequentially generates the amplitude and the phase of the rotation period fluctuation of the desired period of the rotor, and changes the phase into phase information corresponding to the elements-to-be-detected that serve as a reference point.

4. The a rotor drive controlling unit as claimed in claim 1, wherein the elements-to-be-detected are prepared on a rotation plate that rotates around a rotation axle of the rotor.

5. The rotor drive controlling unit as claimed in claim 1, wherein two of the detectors are provided symmetric to a rotation axle of the rotor.

6. The rotor drive controlling unit as claimed in claim 1, wherein the widths of the elements-to-be-detected sequentially increase with reference to an element-to-be-detected having a width no greater than others within one rotation of the rotor.

7. An image formation apparatus, comprising:

the rotor drive controlling unit as claimed in claim 1; wherein the rotor is a photo conductor drum.

8. A rotor drive controlling unit, comprising:

a motor;

a transfer device for transferring a rotational force of the motor;

a rotor connected to the transfer device and rotated by the rotational force of the motor;

at least three pairs of elements-to-be-detected arranged on a periphery centered on a rotation axle of the rotor;

a detector for detecting the elements-to-be-detected;

a passage time detecting unit for detecting an interval between the elements-to-be-detected of one of the pairs passing the detector based on detecting signals generated by the detector;

an amplitude/phase generating unit for generating an amplitude and a phase of a rotation period fluctuation of a desired period of the rotor based on the interval detected by the passage time detecting unit;

a rotation controlling unit for controlling rotation of the motor based on the amplitude and the phase generated by the amplitude/phase generating unit and for reducing the rotation period fluctuation; and a control reference updating unit for updating the phase, at which updated phase a rotation control of the motor is started, based on the phase generated by the amplitude/phase generating unit with reference to the pairs of elements-to-be-detected where intervals between the elements-to-be-detected of the pairs mutually differ.

9. The rotor drive controlling unit as claimed in claim 8, wherein the intervals between the elements-to-be-detected of the pairs sequentially increase with reference to a pair of the elements-to-be-detected having an interval no greater than others within one rotation of the rotor.

10. A rotor drive controlling unit, comprising:

a motor;

a transfer device for transferring a rotational force of the motor;

a rotor connected to the transfer device and rotated by the rotational force of the motor;

at least three elements-to-be-detected arranged on a periphery centered on a rotation axle of the rotor;

a detector for detecting the elements-to-be-detected;

a passage time detecting unit for detecting an interval between adjacent elements-to-be-detected passing the detector based on detecting signals generated by the detector;

an amplitude/phase generating unit for generating an amplitude and a phase of a rotation period fluctuation of a desired period of the rotor based on the interval detected by the passage time detecting unit;

a rotation controlling unit for controlling rotation of the motor based on the amplitude and the phase generated by the amplitude/phase generating unit and for reducing the rotation period fluctuation; and a control reference updating unit for updating the phase, at which updated phase a rotation control of the motor is started, based on the phase generated by the amplitude/phase generating unit with reference to the elements-to-be-detected where the widths of the at least three elements-to-be-detected mutually differ, or the intervals between the at least three elements-to-be-detected mutually differ;

wherein at least two rotation period fluctuations are repeatedly compensated for with the passage time detecting unit, the amplitude/phase generating unit, the rotation controlling unit, and the control reference updating unit.

11. The rotor drive controlling unit as claimed in claim 10, wherein the control reference updating unit collectively changes the phases, at which changed phases the rotation control is started about at least two desired periods based on respective phases generated by the amplitude/phase generating unit.

* * * * *